US006894708B2

(12) United States Patent
Santiago et al.

(10) Patent No.: US 6,894,708 B2
(45) Date of Patent: May 17, 2005

(54) APPARATUS, SYSTEM, AND METHOD FOR FRICTIONALLY REACTING THERMAL PAPER

(75) Inventors: Javier Hernando Santiago, Wake Forest, NC (US); Robert David Parsons, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/421,076

(22) Filed: Apr. 23, 2003

(65) Prior Publication Data

US 2004/0212668 A1 Oct. 28, 2004

(51) Int. Cl.[7] ..... B41J 2/52; B41J 2/315

(52) U.S. Cl. ..... 347/171

(58) Field of Search ..... 347/171, 172, 347/183

(56) References Cited

U.S. PATENT DOCUMENTS

| | | | | | |
|---|---|---|---|---|---|
| 3,816,838 | A | * | 6/1974 | Higaki et al. | 346/135.1 |
| 4,675,701 | A | | 6/1987 | Chu et al. | 346/76 |
| 4,908,631 | A | * | 3/1990 | DeBoer et al. | 347/171 |
| 5,193,922 | A | | 3/1993 | Hayashi | 400/157.1 |
| 5,231,421 | A | | 7/1993 | Yoshida et al. | 346/76 |
| 5,696,547 | A | | 12/1997 | Takeda et al. | 347/186 |

FOREIGN PATENT DOCUMENTS

| | | | | | |
|---|---|---|---|---|---|
| GB | 1372737 | | * | 11/1974 | B41J/3/20 |
| JP | 54-18756 | | * | 2/1979 | B41J/3/20 |
| JP | 55049292 | A | | 4/1980 | B41M/5/00 |
| JP | 60096466 | A | | 5/1985 | B41J/3/20 |
| JP | 60253573 | A | | 12/1985 | B41J/11/02 |
| JP | 61-037444 | | * | 2/1986 | B41J/3/10 |
| JP | 61206671 | A | | 9/1986 | B41J/3/20 |
| JP | 62-140854 | | * | 6/1987 | B41J/3/20 |
| JP | 62-161566 | | * | 7/1987 | B41M/5/26 |
| JP | 64-24768 | | * | 1/1989 | B41J/3/20 |
| JP | 1163074 | A | | 6/1989 | B41J/3/20 |
| JP | 01-320195 | | * | 12/1989 | 101/32 |
| JP | 2-45162 | | * | 2/1990 | B41J/2/32 |
| JP | 02-245375 | | * | 10/1990 | B41M/5/26 |
| JP | 4010953 | A | | 1/1992 | B41J/2/32 |
| JP | 4244860 | A | | 9/1992 | B41J/2/335 |
| JP | 4355160 | A | | 12/1992 | B41J/2/295 |
| JP | 5330162 | A | | 12/1993 | B41J/11/02 |
| JP | 6270428 | A | | 9/1994 | B41J/2/32 |
| JP | 8258296 | A | | 10/1996 | B41J/2/32 |
| JP | 10254359 | | | 9/1998 | G09F/3/02 |
| JP | 2000003227 | A | | 1/2000 | G06F/1/16 |
| JP | 2000079713 | A | | 3/2000 | B41J/2/32 |

OTHER PUBLICATIONS

*Multiple Copy Thermal Printing Via Ultrasonic Absorption, IBN Technical Disclosure Bulletin*, vol. 19 No. 1 Jun. 1976, pp. 365–366.

* cited by examiner

*Primary Examiner*—Huan Tran
(74) *Attorney, Agent, or Firm*—Kunzler & Associates

(57) ABSTRACT

A frictional printing device, system and method prints on thermal paper using heat generated by frictional contact. A frictional actuator motivates a frictional heating element to frictionally contact the thermal paper. The thermal paper is chemically treated to react to heat by changing color. Heat is generated by frictional contact of the frictional heating element against the thermal paper. The frictional contact may be provided through repetitive movement of the frictional heating element. An image is formed by selectively positioned frictional contact between the frictional heating element and the thermal paper.

29 Claims, 8 Drawing Sheets

APPARATUS, SYSTEM, AND METHOD FOR FRICTIONALLY REACTING THERMAL PAPER

BACKGROUND OF THE INVENTION

1. The Field of the Invention

The invention relates to devices, methods, and systems for printing with thermal paper. Specifically, the invention relates to devices, methods, and systems for printing by frictionally reacting thermal paper.

2. The Relevant Art

A number of technologies have been employed for printing applications. For instance, impact printers have been used to provide high-speed, cost-effective printing. In an impact printer, a printing pin strikes a printer ribbon, transferring ink from the printer ribbon to a paper. A limiting characteristic of impact printers is that the printer ribbon requires transport and storage mechanisms within the printer. Also, printer ribbons must also be periodically changed, increasing maintenance costs. As a result, impact printers are often unsuitable for applications requiring small printer size and low maintenance, such as point-of-sale applications.

Laser printers have also been used extensively to provide high-speed printing. A laser printer deposits a charge on drum that attracts toner. The drum then transfers the toner to a paper. However, the laser printer drum requires significant space, and toner must also be periodically added. Consequently, laser printers also have typically not been used for applications requiring printers of small size and low maintenance.

Ink jet printers are also frequently used due to their low initial cost. Ink jet printers apply small jets of ink to paper. However, ink jet printers require the ink reservoir to be located close to the print mechanism, increasing the size of the printer mechanism. The print mechanism/reservoirs of an ink jet printer must also be replaced frequently, increasing the cost and maintenance of the printer. As a result, ink jet printers also have typically not been used for applications requiring small printer size, low maintenance, and low per page cost.

Thermal paper printers are used extensively in printing applications to overcome many of the limitations of impact, laser and ink jet printers, particularly in point of sale applications. Thermal paper is treated chemically to react when heated, forming a mark on the heated portion of the paper. In operation of a thermal paper printer, heating elements are used to react the thermal paper. Thermal paper printers are widely used for printing applications that demand small printer size and low maintenance, because the heating elements of the thermal paper printer require little space, and toner, ribbons, and ink reservoirs are not needed. Thermal paper printers are also attractive because little maintenance is required aside from adding paper.

In a thermal paper printer, the heat applied to each area of the thermal paper must be carefully controlled to produce a clean, legible printed copy. Some thermal papers react to specific temperature ranges by forming unique colors, making temperature control even more critical. A disadvantage of thermal paper printers is that thermal paper printer heating elements do not heat and cool immediately. Thermal printing elements often must move at slower speeds to maintain the appropriate temperatures over each portion of the thermal paper. Because printing speeds are limited by the thermal characteristics of the heating elements, typical thermal paper printers do not print as quickly as desired for many applications.

Slow printing speeds are particularly an issue in point of sale applications, where slower printing reduces a cashier's throughput. Faster thermal paper printers are desirable, because they could be used to print more detailed, informative, and useful receipts, contracts, warranties, and other customized documents. Faster thermal paper printers could also find application in other printing segments that have been impractical because of slow printing speeds.

Accordingly, what is needed is a device, method, and system for rapidly and selectively heating thermal paper. In particular, the device, method, and system should react thermal paper using frictionally generated heat. The frictional heat would optimally be generated and applied selectively at high speeds. Such a printer using frictionally generated heat to react thermal paper would print rapidly, while maintaining a thermal paper's principle advantages of small size and low maintenance. Such an improved device, method, and system would allow the rapid printing of large documents with small printers, improving the efficiency of many tasks including point-of-sale printing.

SUMMARY OF THE INVENTION

The various elements of the present invention have been developed in response to the present state of the art, and in particular, in response to the problems and needs in the art that have not yet been fully solved by currently available thermal paper printing methods. Accordingly, the present invention provides an improved apparatus, method, and system for frictionally reacting thermal paper.

In one aspect of the present invention, an apparatus for frictionally reacting thermal paper is presented. The apparatus employs thermal paper that has been chemically treated to react to heat by changing colors. The apparatus positions a frictional actuator adjacent to an area of the thermal paper that will be reacted as part of a printing operation. The frictional actuator motivates a frictional heating element to contact the thermal paper. The frictional heat of the frictional heating element contacting the thermal paper reacts the thermal paper and changes the color of the desired area of the paper.

In one embodiment, the apparatus positions the frictional actuator adjacent to an area to be printed with a location actuator. The apparatus may also position the thermal paper with a paper actuator. The frictional actuator, location actuator, and paper actuator may be controlled by a microprocessor.

In certain embodiments, the frictional heating element contacts the thermal paper in a repetitive rubbing motion. In one embodiment, the frictional heating element vibrates parallel to the surface of the paper. In an alternate embodiment, the frictional heating element vibrates perpendicular to the surface of the paper. The frictional heating element may be motivated by a vibrator, such as a piezoelectric motor. Various geometric shapes may be used for the frictional heating element to enable frictional contact with the surface of the paper such as a disk, a drum, a cylinder, a dome, or the like.

In another aspect of the present invention, a method for printing on thermal paper with frictional heat is presented. The method motivates a frictional heating element that contacts thermal paper. The friction of the heating element contacting the thermal paper generates heat that reacts the thermal paper, altering the color of the paper to form a desired image.

In certain embodiments, the frictional heating element contacts the thermal paper with a repetitive rubbing motion wherein the darkness or color of printing is controlled by the duration of contact. In one embodiment, the repetitive rubbing motion is a substantially circular motion conducted by a frictional heating element that rotates either substantially perpendicular to, or substantially parallel with, the surface of the paper.

Various elements of the present invention may be combined into a system for frictionally printing on thermal paper. The system positions a frictional heating element adjacent to thermal paper that is configured to react to heat by changing color. A frictional actuator motivates the frictional heating element, which contacts the thermal paper. The frictional heat of the heating element contacting the thermal paper reacts the paper, altering the paper's color.

In one embodiment, the system employs a mechanical linkage connected to a stepper motor as a location actuator to position the frictional actuator. The system may also employ a roller connected to a stepper motor as a paper actuator to position the thermal paper.

In one embodiment, a microprocessor controls the frictional actuator, the location actuator, and the paper actuator. Program code stored in a storage device within the system directs the microprocessor to position the frictional actuator. Program code further directs the microprocessor to motivate the frictional heating element to generate frictional heat sufficient to react the thermal paper.

An advantage of the present invention is that it facilitates rapid printing on thermal paper. The various elements and aspects of the present invention provide for a small printer capable of high output. As a further advantage, the present invention increases speed without increasing maintenance costs. These and other features and advantages of the present invention will become more fully apparent from the following description and appended claims, or may be learned by the practice of the invention as set forth hereinafter.

BRIEF DESCRIPTION OF THE DRAWINGS

In order that the manner in which the advantages and objects of the invention are obtained will be readily understood, a more particular description of the invention briefly described above will be rendered by reference to specific embodiments thereof, which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of executable code may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of executable code could be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

Figure 1:
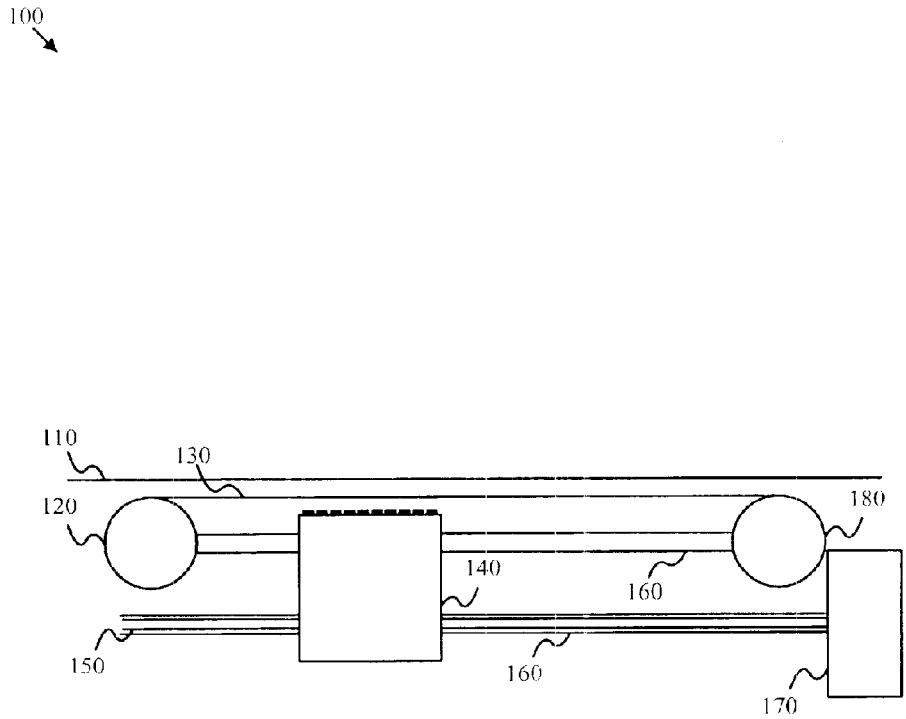
(Prior Art) Fig. 1
FIG. 1 is a side view of a typical prior art impact printer.

FIG. 1 shows an impact printer of the prior and further illustrates in greater detail problems and issues inherent in the prior art impact printers 100 discussed previously in the background section. The depicted prior art impact printer 100 includes a paper 110, a first ribbon reel 120, a printer ribbon 130, a print mechanism 140, a mechanical linkage 150, one or more supports 160, a stepper motor 170, and a second ribbon reel 180.

The printer ribbon 130 is mounted between the first ribbon reel 120 and the second ribbon reel 180 and adjacent to the paper 110. The print mechanism 140 is mounted on one or more supports 160 adjacent to the printer ribbon 130 and is connected to the mechanical linkage 150. The stepper motor 170 drives the mechanical linkage 150, selectively positioning the print mechanism 140.

Figure 2:
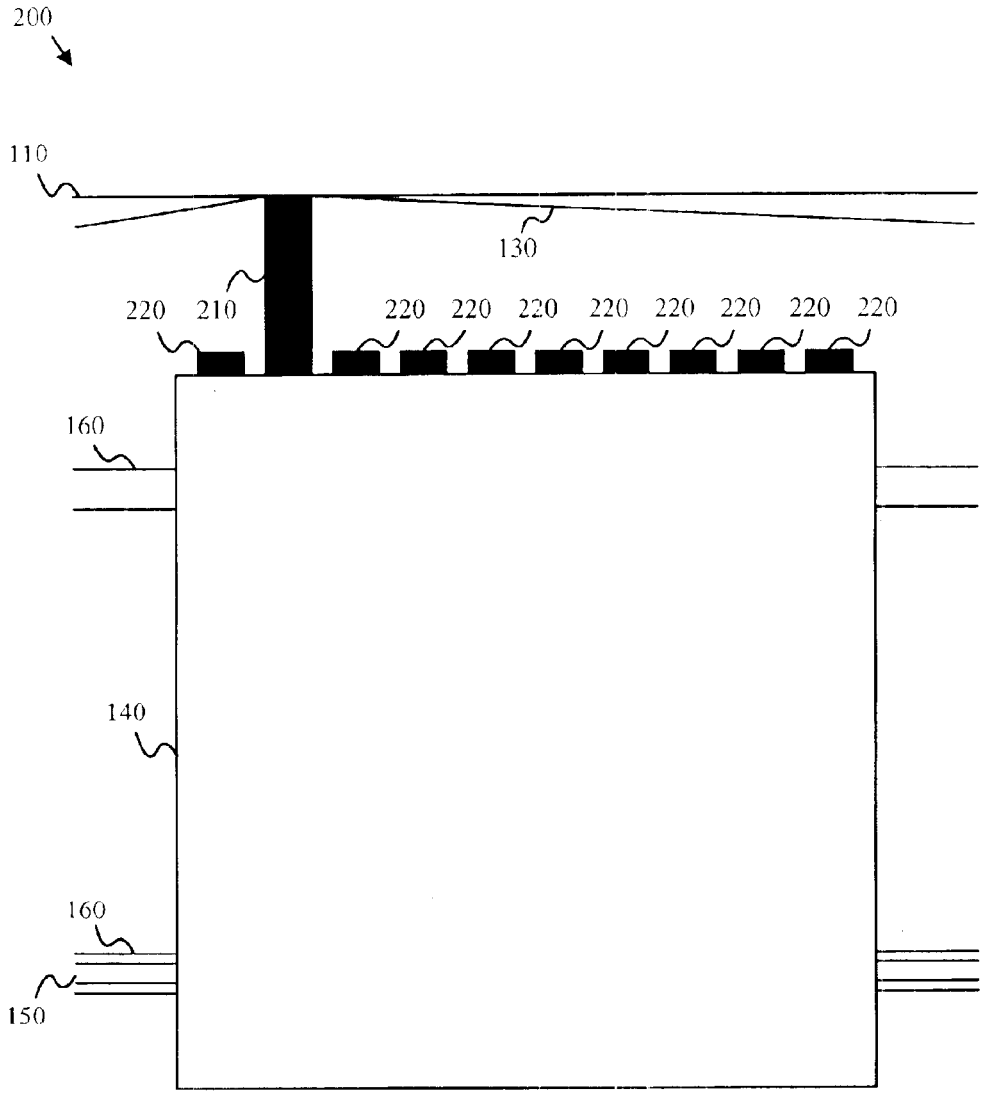
(Prior Art) Fig. 2
FIG. 2 is a side view of a typical prior art impact printer print mechanism.

FIG. 2 is an illustration depicting a typical prior art impact printing mechanism 200. The print mechanism 200 includes a paper 110, a printer ribbon 130, a print mechanism 140, a mechanical linkage 150, one or more supports 160, and one or more impact pins 210 and 220. The print mechanism 200 transfers ink from a printer ribbon 130 to a paper 110 by impacting the printer ribbon 130 against the paper 110.

The print mechanism 140 is mounted on one or more supports 160 adjacent to the printer ribbon 130 as shown in FIG. 1. The print mechanism 140 actuates the impact pin 210, causing the impact pin 210 to press the printer ribbon 130 against the paper 110. The printer ribbon 130 transfers ink to the paper 110. Repeated selectively located impacts of the impact pins 210 and 220 against the printer ribbon 130 creates an image on the paper.

Figure 3:
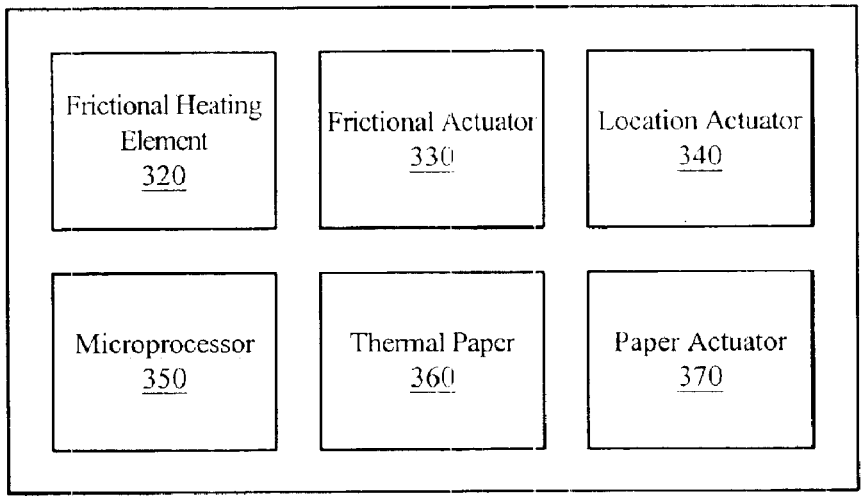
FIG. 3 is a block diagram depicting one embodiment of a frictional thermal printer of the present invention.

FIG. 3 is a block diagram depicting one embodiment of a frictional thermal printer 300 of the present invention. The frictional thermal printer 300 reacts thermal paper 360 using frictionally generated heat. In the depicted embodiments, the frictional thermal printer 300 includes a frictional heating element 320, a frictional actuator 330, a location actuator 340, a microprocessor 350, a thermal paper 360, and a paper actuator 370.

The paper actuator 370 positions a line of the thermal paper 360 adjacent to the frictional actuator 330, and the location actuator 330 further positions the frictional actuator 330 adjacent to a target area of the thermal paper 360. The frictional heating element 320 is connected to the frictional actuator 330 and is further positioned to contact the thermal paper 360. The frictional actuator 330 motivates the frictional heating element 320, causing frictional contact of the frictional heating element 320 and the thermal paper 360, which in turn generates heat. The frictional heat reacts the thermal paper 360 in the target area, changing the paper's 360 color.

In certain embodiments, the frictional heating element 320 contacts the thermal paper 360 with a repetitive rubbing motion, and the darkness or color of printing is controlled by the duration of contact. In one embodiment, the repetitive rubbing motion is a substantially circular motion conducted by a frictional heating element that rotates either substantially perpendicular to, or substantially parallel with, the surface of the paper.

The materials used for the frictional heating element 320 may have low thermal conductivity in order to reduce heat transfer into the other components of the frictional thermal printer 400. The coefficient of friction of the frictional heating element 320 with the thermal paper 360 and the applied contact force may be carefully selected to facilitate frictional heating while reducing the probability of tearing the thermal paper.

Figure 4:
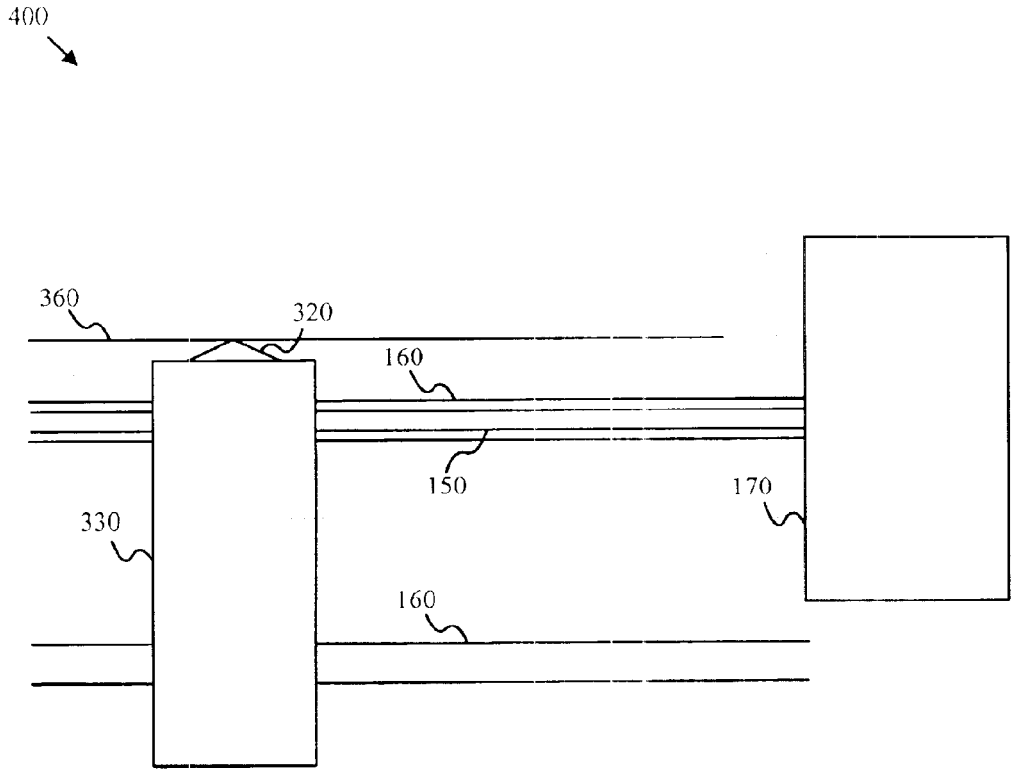
FIG. 4 is a side view of one embodiment of a frictional thermal printer of the present invention.

FIG. 4 is a simplified side view illustration depicting one embodiment of a frictional thermal printer 400 of the present invention. The frictional thermal printer 400 is configured to selectively position a frictional actuator 330 to frictionally react the thermal paper 360. The frictional thermal printer 400 includes a mechanical linkage 150, one or more supports 160, a stepper motor 170, a frictional heating element 320, a frictional actuator 330, and a thermal paper 360.

In operation the frictional actuator 330 is positioned adjacent to the thermal paper 360 by one or more supports 160 and is further connected to the mechanical linkage 150. Revolutions of the stepper motor 170 drive the mechanical linkage 150, positioning the frictional actuator 330. In one embodiment, the mechanical linkage 150 is a belt. The belt is driven by the shaft of the stepper motor 170. The stepper motor 170 rotates in response to a location control signal.

The frictional actuator 330 is connected to the frictional heating element 320. The frictional heating element 320 is positioned to contact the thermal paper 360. The frictional actuator 330 motivates the frictional heating element 320. The frictional contact of the frictional heating element 320 and the thermal paper 360 generates heat, which reacts the thermal paper 360, changing the paper's 360 color.

Figure 5:
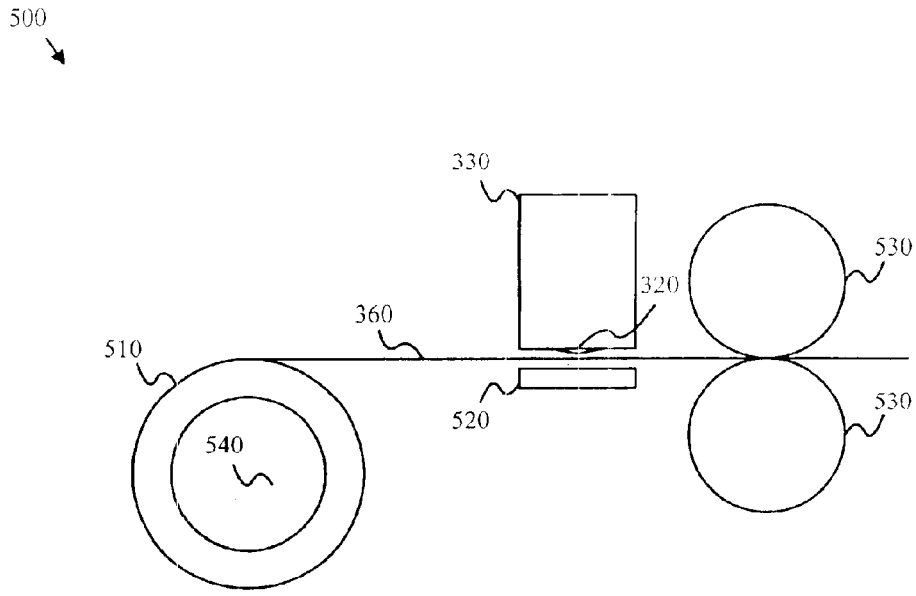
FIG. 5 is a side view of one embodiment of a frictional thermal printer of the present invention.

FIG. 5 is a simplified side view illustration depicting one embodiment of a frictional thermal printer 500 of the present invention. The frictional thermal printer 500 positions thermal paper 360 using one or more rollers 530. In the depicted embodiment, the frictional thermal printer 500 includes a frictional heating element 320, a frictional actuator 330, a thermal paper 360, a thermal paper roll 510, a print platform 520, one or more paper rollers 530, and a roller stepper motor.

The thermal paper roll 510 dispenses the thermal paper 360. The thermal paper 360 is supported by one or more paper rollers 530. Rotations of the paper roller 530 position the thermal paper 360 between the print platform 520 and the frictional heating element 320. The print platform 520 supports contact between the frictional heating element 320 and the thermal paper 360.

In the depicted embodiment, the paper roller 530 is attached to the shaft of a roller stepper motor 540. Rotations of the roller stepper motor 540 rotate the paper roller 320 in response to a paper control signal. The location control signal and the paper control signal cooperate to position the frictional actuator 330 adjacent to a target area.

Figure 6:
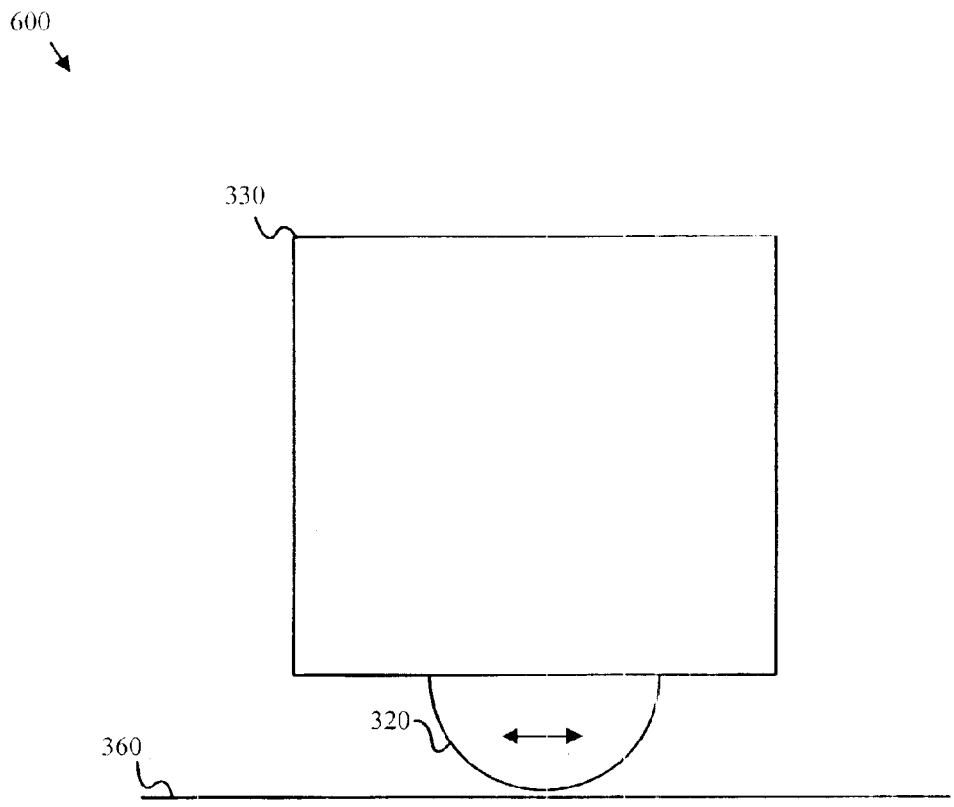
FIG. 6 is a top view of one embodiment of a frictional print mechanism of the present invention.

FIG. 6 is a simplified top view illustration depicting a frictional print mechanism 700 of the present invention. The frictional print mechanism 600 includes a frictional heating element 320, a frictional actuator 330, and thermal paper 360.

The frictional actuator 330 motivates the frictional heating element 320. As depicted, the frictional heating element 320 vibrates or rotates parallel to the thermal paper 360. The frictional heat of the contact between the frictional heating element 320 and the thermal paper 360 reacts the thermal paper. In one alternate embodiment, the frictional heating element 320 vibrates perpendicular to the thermal paper 360.

Figure 7:
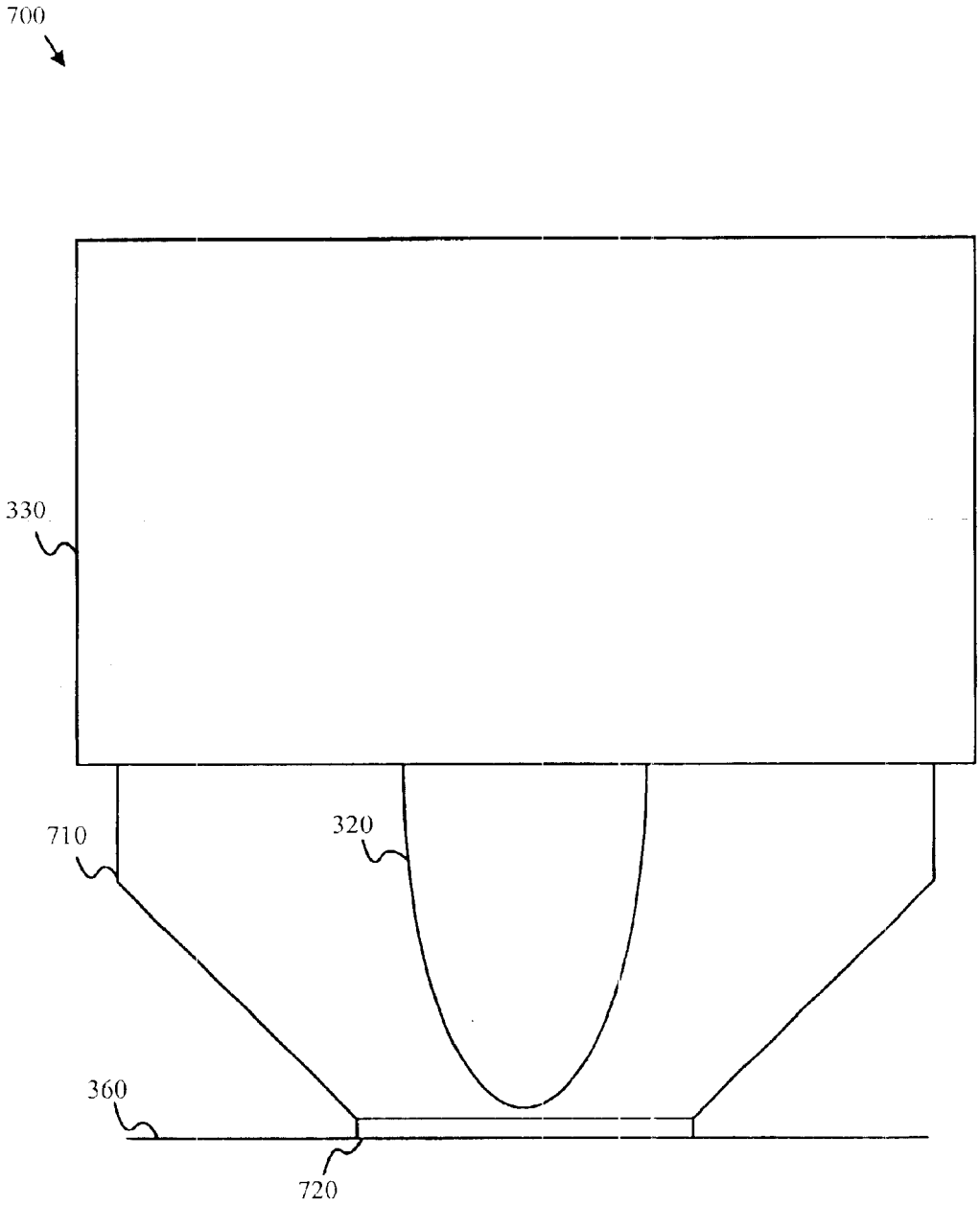
FIG. 7 is a top view of one embodiment of a frictional heating element and transfer pad of the present invention.

FIG. 7 is a simplified top view illustration depicting a frictional heating element 700 with transfer pad 720. The frictional heating element 700 with transfer pad 720 frictionally reacts thermal paper 360 without direct frictional contact with the thermal paper 360. The frictional heating element with transfer pad 700 includes a frictional heating element 320, a frictional actuator 330, a thermal paper 360, a transfer pad frame 710, and a transfer pad 720.

The transfer pad frame 710 mounts the transfer pad 720 to the frictional actuator 330 such that the transfer pad 720 is in contact with the frictional heating element 320. The transfer pad 720 is further in contact with the thermal paper 360. The frictional actuator 330 motivates the frictional heating element 320 to frictionally contact the transfer pad 720. Frictional heat generated by the frictional heating element 320 heats the transfer pad 720. The frictional heat is transferred through the transfer pad 720 to the thermal paper 360, reacting the thermal paper 360. In one embodiment, the transfer pad 720 is a replaceable wear component.

Figure 8:
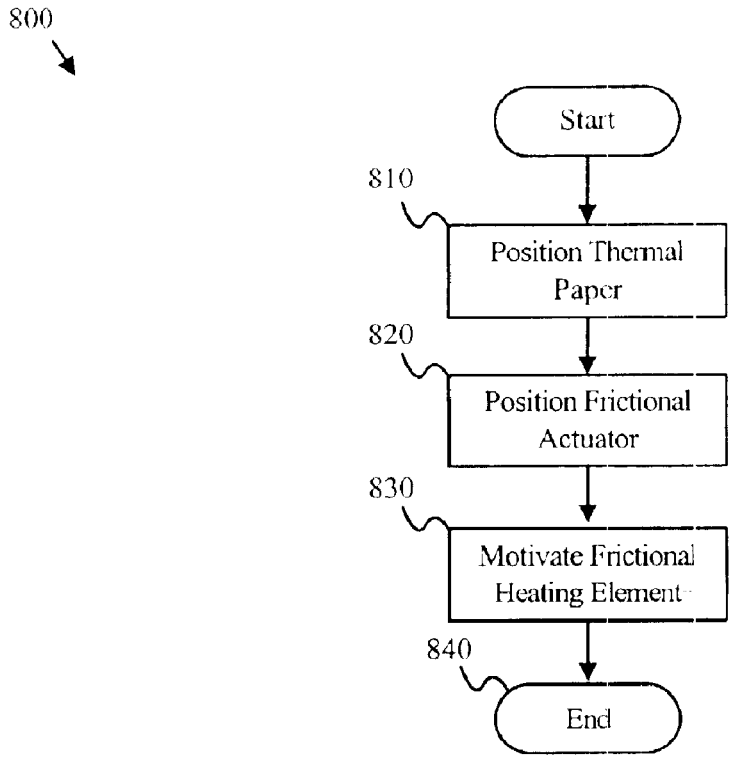
FIG. 8 is a flow chart diagram illustrating a method of frictional thermal printing of the present invention.

FIG. 8 is a flow chart illustrating a method 800 of frictional thermal printing of the present invention. The method 800 prints on thermal paper 360 using frictionally generated heat. The method 800 includes a position thermal paper step 810, a position frictional actuator step 820, a motivate frictional heating element step 830, and an end step 840. Although for purposes of clarity the steps of the frictional printing method 800 are depicted in a certain sequential order, execution within an actual system may be conducted in parallel and not necessarily in the depicted order.

The position thermal paper step 810 positions the thermal paper 360 relative to the thermal actuator 330. The position frictional actuator step 820 further positions the thermal actuator 330 relative to a target area of the line of thermal paper 360. The motivate frictional heating element step 830 motivates a frictional heating element such as the frictional heating element 320. The frictional heating element 320 frictionally contacts the thermal paper 360. The frictional heat of contact reacts the thermal paper 360. The method 800 terminates with the end step 840.

The present invention facilities high-speed printing on thermal paper while retaining the small size and low-maintenance advantages of prior art thermal paper printers. Printing is accomplished at high mechanical speeds without the limitations of the heating and cooling properties of traditional heating elements.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A frictional printing device comprising:

a frictional heating element configured to frictionally contact thermal paper with a repetitive motion;

a frictional actuator configured to motivate the frictional heating element for a controlled duration thereby reacting the thermal paper; and wherein the repetitive motion and the controlled duration of contact affect the darkness of the thermal paper reaction.

2. The frictional printing device of claim 1, further comprising a location actuator configured to position the frictional actuator.

3. The frictional printing device of claim 2, wherein the location actuator comprises a stepper motor and a mechanical linkage configured to position the frictional actuator in response to rotations of the stepper motor.

4. The frictional printing device of claim 1, further comprising a paper actuator configured to position thermal paper.

5. The frictional printing device of claim 4, wherein the paper actuator comprises a stepper motor and a roller configured to position the thermal paper in response to the rotations of the stepper motor.

6. The frictional printing device of claim 1 or claim 4 further comprising a microprocessor configured to control the position of a location actuator and a paper actuator.

7. The frictional printing device of claim 1, wherein the frictional heating element is configured to vibrate in a manner parallel to the surface of the thermal paper.

8. The frictional printing device of claim 1, wherein the frictional heating element is configured to vibrate in a manner perpendicular to the surface of the thermal paper.

9. The frictional printing device of claim 1, wherein the frictional heating element is configured to frictionally heat a transfer pad, the transfer pad configured to contact the thermal paper.

10. The frictional printing device of claim 1, wherein the frictional actuator comprises an ultrasonic vibrator configured to motivate the frictional heating element.

11. The frictional printing device of claim 1, wherein the frictional actuator comprises a piezo-electric vibrator configured to motivate the frictional heating element.

12. A system for printing, the system comprising:

thermal paper configured to react to heat by changing color;

a frictional heating element configured to frictionally contact thermal paper with repetitive motion;

a frictional actuator configured to motivate the frictional heating element for a controlled duration, thereby reacting the thermal paper; and wherein the repetitive motion and controlled duration of contact affect the darkness of the thermal paper reaction.

13. The system of claim 12, further comprising a location actuator configured to position the frictional actuator.

14. The system of claim 13, wherein the location actuator comprises a motor module and a mechanical linkage module configured to position of the frictional actuator in response to rotations of the motor module.

15. The system of claim 12, further comprising a paper actuator configured to position the thermal paper.

16. The system of claim 15, wherein the paper actuator comprises a roller configured to position thermal paper and a motor configured to motivate the roller module.

17. The system of claim 12, wherein the frictional actuator is an ultrasonic vibrator.

18. The system of claim 12, wherein the frictional actuator is a piezo-electric vibrator.

19. A method for printing, the method comprising:

motivating a frictional heating element for a controlled duration, thereby reacting thermal paper;

frictionally heating thermal paper with contact from the frictional heating element with a repetitive motion; and wherein the repetitive motion and controlled duration of contact affect the darkness of the thermal paper reaction.

20. The method of claim 19, further comprising positioning the paper to receive the frictional heating element.

21. The method of claim 19, further comprising positioning the frictional heating element to frictionally heat a selected area of the thermal paper.

22. An apparatus for printing, the apparatus comprising:

means for frictionally contacting thermal paper, with a repetitive motion;

means for motivating the means for frictional contact for a controlled duration, thereby reacting the thermal paper; and wherein the repetitive motion and controlled duration of contact affect the darkness of the thermal paper reaction.

23. The apparatus of claim 22, the apparatus further comprising means for positioning the means for motivating.

24. The apparatus of claim 22, further comprising means for positioning the thermal paper.

25. A computer readable storage medium comprising computer readable program code for frictionally reacting thermal paper, the program code configured to:

motivate a frictional heating element for a controlled duration, thereby reacting thermal paper;

frictionally heat thermal paper with contact from the frictional heating element with a repetitive motion; and wherein the repetitive motion and controlled duration of contact affect the darkness of the thermal paper reaction.

26. The computer readable storage medium of claim 25, wherein the computer readable code is further configured to position thermal paper.

27. The computer readable storage medium of claim 25, wherein the computer readable code is further configured to modify the frictional energy of the frictional heating element.

28. The computer readable storage medium of claim 25, wherein the program code is further configured to repetitively motivate the frictional heating element.

29. The computer readable storage medium of claim 25, wherein the computer readable code is further configured to modify a vibration frequency associated with the frictional heating element.

* * * * *